US006790016B2

(12) United States Patent
Chiang

(10) Patent No.: US 6,790,016 B2
(45) Date of Patent: Sep. 14, 2004

(54) MOTOR AND ITS BLADE UNIT

(76) Inventor: Ching-Yuan Chiang, No.50, Lane 207, Tai-Ping. W. Rd, Ping-Chen City, Taoyuan Hsiang (TW)

( * ) Notice: Subject to any disclaimer, the term of this patent is extended or adjusted under 35 U.S.C. 154(b) by 0 days.

(21) Appl. No.: 10/061,246

(22) Filed: Feb. 4, 2002

(65) Prior Publication Data

US 2003/0147760 A1 Aug. 7, 2003

(51) Int. Cl.[7] ..... F04B 17/00; F04B 35/04

(52) U.S. Cl. ..... 417/423.1; 415/121.1; 415/72; 416/203

(58) Field of Search ..... 417/423.1; 415/121.1, 415/72, 73; 416/175, 176, 203

(56) References Cited

U.S. PATENT DOCUMENTS 2,436,246 A * 2/1948 Braga ..... 60/39.35
3,107,626 A * 10/1963 Thoren et al. ..... 417/69
3,274,410 A * 9/1966 Boivie ..... 310/62
3,632,219 A * 1/1972 Taylor ..... 415/72
4,978,276 A * 12/1990 Kabelitz et al. ..... 415/55.3
5,049,134 A * 9/1991 Golding et al. ..... 604/151
6,018,208 A * 1/2000 Maher et al. ..... 310/254
6,116,862 A * 9/2000 Rau et al. ..... 417/319
6,210,133 B1 * 4/2001 Aboul-Hosn et al. .... 417/423.1
6,464,452 B2 * 10/2002 Iwane ..... 415/72
6,478,555 B1 * 11/2002 Kim et al. ..... 417/420

* cited by examiner

*Primary Examiner*—Justine R. Yu
*Assistant Examiner*—William H. Rodriguez
(74) *Attorney, Agent, or Firm*—Troxell Law Office PLLC

(57) ABSTRACT

A motor and its blade unit include a blade unit made of a conical fundamental body and a plurality of blades formed around the surface of the conical fundamental body. The blades of the blade unit are multi-sectioned ones of different sizes. These blades increase water flowing speed with help of the centrifugal force produced by rotating of the blade unit, and quickly guide water to flow along the outer wall of a motor and out of the motor, not to flow reversely back to a shaft. At the same time these blades can cut impurities in water preventing the motor from clogged by impurities, increasing water flowing-out speed, lowering motor load and electricity consumption and saving motor horsepower to prolong its service life, and also possible to be combined with various types of motors for extensive use.

2 Claims, 9 Drawing Sheets

MOTOR AND ITS BLADE UNIT

BACKGROUND OF THE INVENTION

This invention relates to a motor and its blade unit, particularly to one capable to increase water flowing-out speed, lower motor load and electricity consumption, economize horsepower and prolong service life of a motor.

A conventional motor blade unit, as shown in FIG. 1, is composed of helical blades 11 installed inside, and a hollow shaft 12. Although a conventional motor can strengthen the pressure absorbing water and guide water to flow into the flowing passage 121 of the shaft 12, yet the blade unit 11 can only guide water to flow, but cannot divide water to lower water load, nor can it cut impurities mixed in water and increase water flowing-out speed, resulting in a comparatively large motor load, high electricity consumption and a short service life of the motor.

SUMMARY OF THE INVENTION

The objective of the invention is to offer a motor and its blade unit, which can increase water flowing-out speed and lower motor load and electricity consumption to save the horsepower of a motor and prolong its service life.

The blade unit in this invention are made of a conical fundamental body and a plurality of blades formed around the surface of the fundamental body. The feature of the invention is that the blades formed on the surface of the blade unit are multi-sectioned ones of different sizes. These blades can increase water flowing speed with help of the centrifugal force produced by rotating of the blade unit to let the water flow along the outer wall of the motor and quickly be guided to flow out, not to flow back to a shaft. Besides, the blades of the blade unit can cut impurities in water so as to prevent the motor from blocked by such impurities. Thus, the device of this invention can not only increase water flowing-out speed, lower motor load and electricity consumption, and economize horsepower of a motor to prolong its service life, but also be combined with various styles of motors for comparatively extensive use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
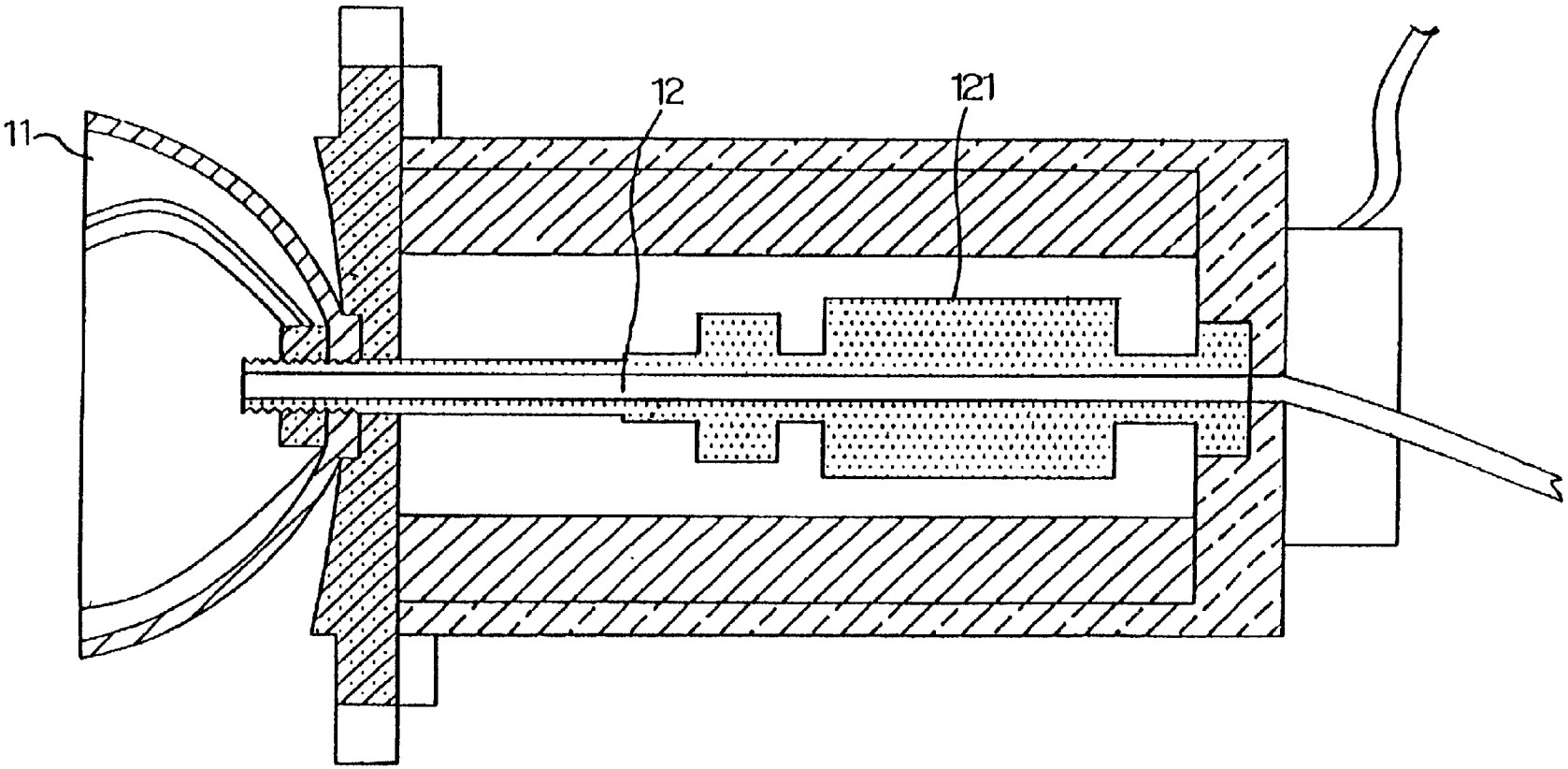
Fig.1 Prior Art
FIG. 1 is a cross-sectional view of a conventional motor and its blade unit.
Figure 2:
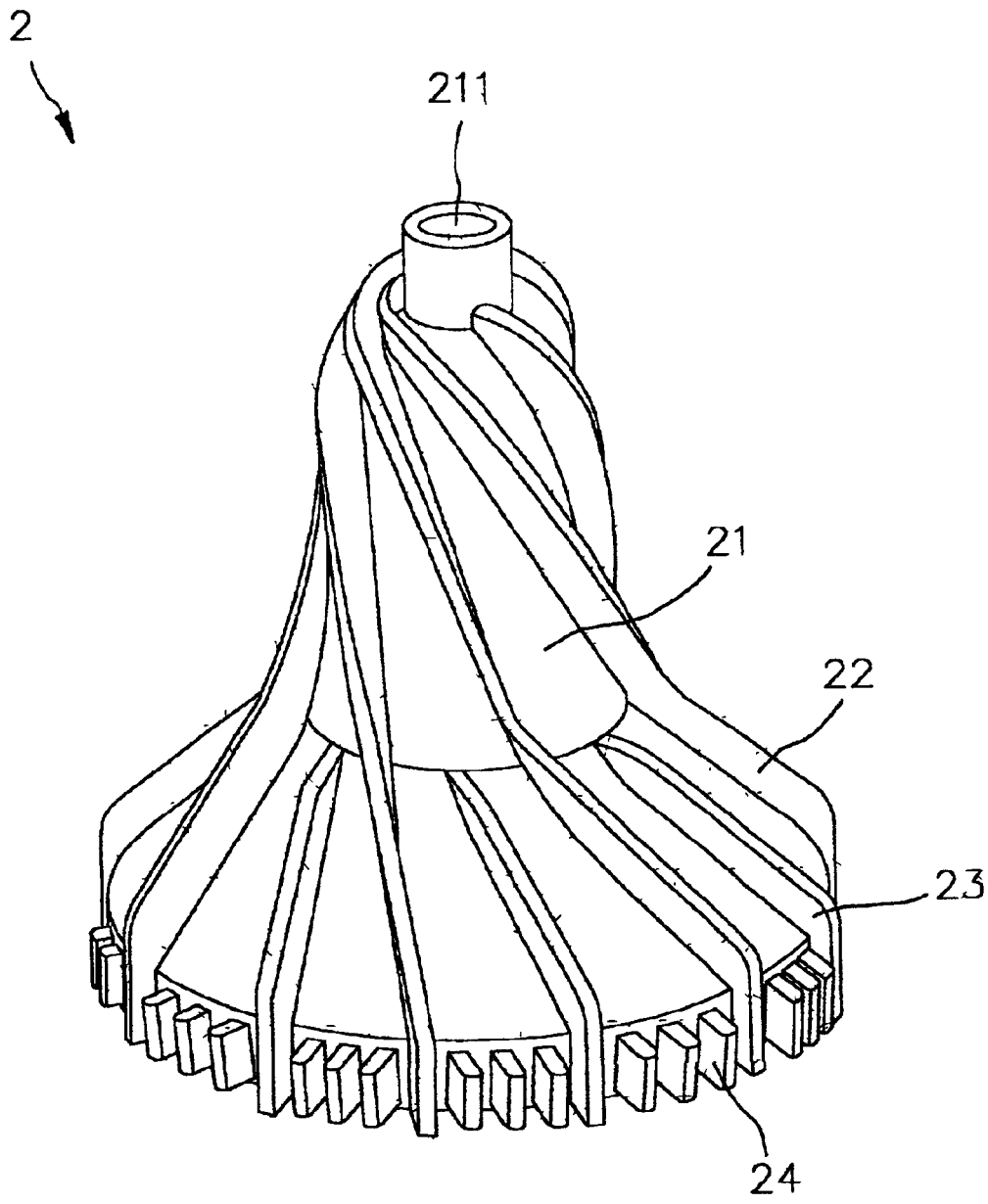
FIG. 2 is a perspective view of a first embodiment of a blade unit in the present invention.
Figure 3:
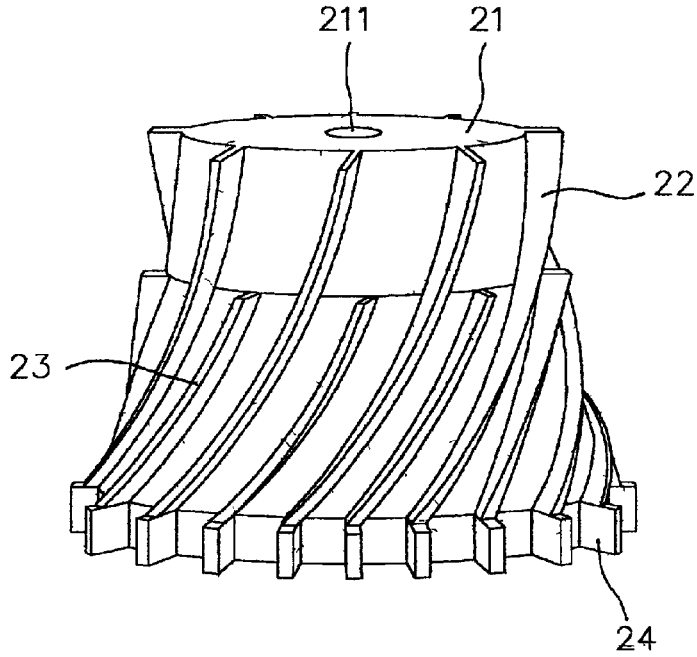
FIG. 3 is a perspective view of a second embodiment of a blade unit in the present invention.
Figure 5:
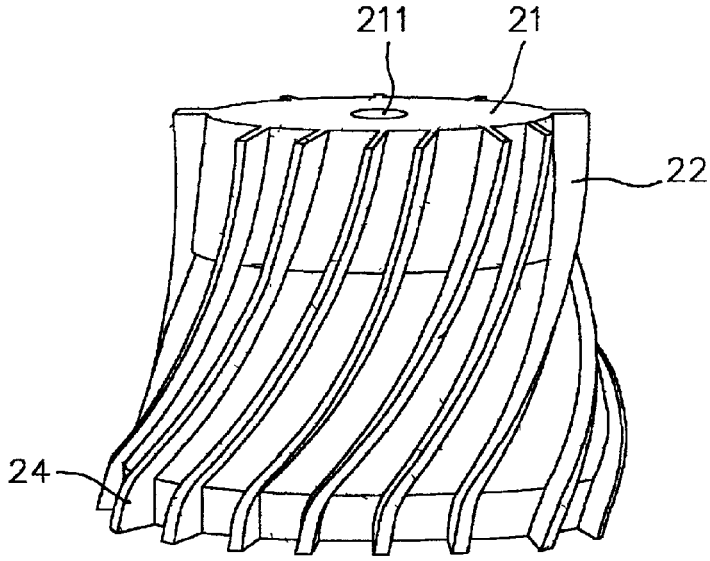
FIG. 5 is a perspective view of a third embodiment of a blade unit in the present invention.
Figure 4A:
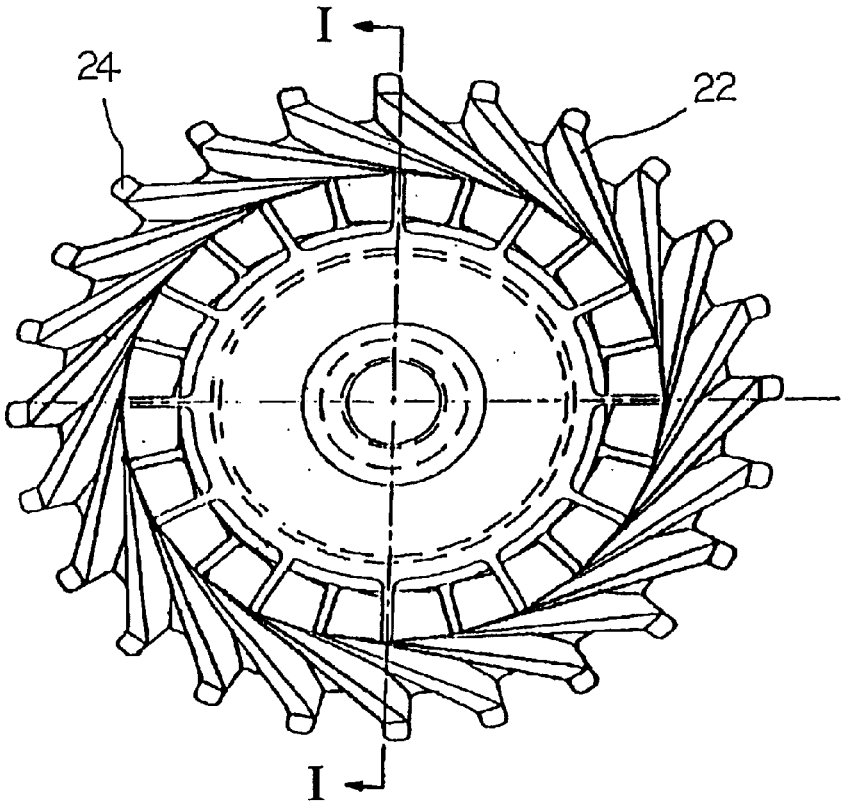
FIG. 4A is an upper view of the second embodiment of the blade unit in the present invention.
Figure 4B:
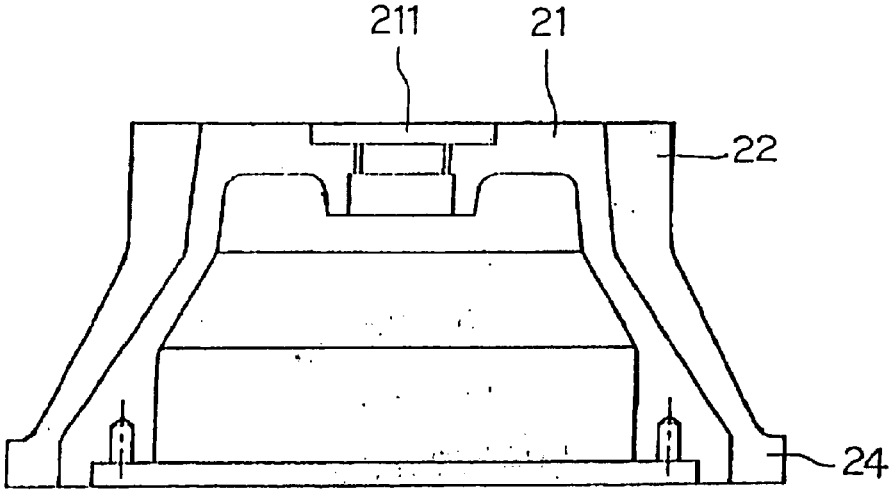
FIG. 4B is a cross-sectional view of the second embodiment of the blade unit in the present invention taken along line I—I in FIG. 4A.

A motor and its blade unit 2 in the present invention, as shown in FIGS. 2, 3, 4A, and 5, includes a motor 3 and a blade unit 2 composed of a fundamental body 21 and a plurality of blades 22, 23 and 24 formed on the surface of the fundamental body 21.

The fundamental body 21 is a metal block with a hollow interior and a conical profile. The conical slant of the fundamental body 21 helps water to be guided to pass therethrough quickly to increase the flowing speed of water. The fundamental body 21 is provided with a through hole 211 on top for a rotating shaft 31 to be inserted through and combined with and driven by a motor to rotate, with the blade unit 2 rotating together with fundamental body 21.

The blades 22, 23 and 24 are projecting ones formed spaced apart on the surface of the fundamental body 21. The blades 22, 23 and 24 are multi-sectioned ones of different sizes so as to guide water to pass therethrough with quickness and cut impurities in water to prevent the motor from clogged by impurities, thus lowering motor load and electricity consumption as well.

Specifically, the blades 22, 23 and 24 of the blade unit 2 are multi-sectioned ones consisting of a plurality of large blades 22, medium blades 23 and small blades 24. Each medium blade 23 is positioned between every two large blades 22, and the small blades 24 are formed spaced apart equidistantly around the bottom end of the fundamental body 21, with each small blade 24 protruding out vertically or slantingly.

When water flows into the blade unit 2, the large blades 22 first divide water and cut impurities in water, and when water gets to the medium blades 23, it pauses for an instant and is again divided into plural passages of flowing water, and then is quickly guided to flow to the small blades 24 with help of the slant of the blade unit 2. At the same time, the centrifugal force produced by the rotating of the blade unit 2 helps increase the flowing speed of water around the small blades 24 to let the water flow out fast along the outer wall of the motor 3, not to flow reversely back to the shaft of the motor 3.

To sum up, the blade unit 2 in the present invention is formed with the multi-sectioned blades 22, 23 and 24, which are capable to divide water into a plurality of flowing passages and cut impurities in water. Besides, the slant of the conical blade unit 2 and the centrifugal force produced by rotating of the blade unit 2 help increase water flowing-out speed, thus lowering motor load and electricity consumption, and saving the horsepower of a motor to prolong its service life.

Figure 6:
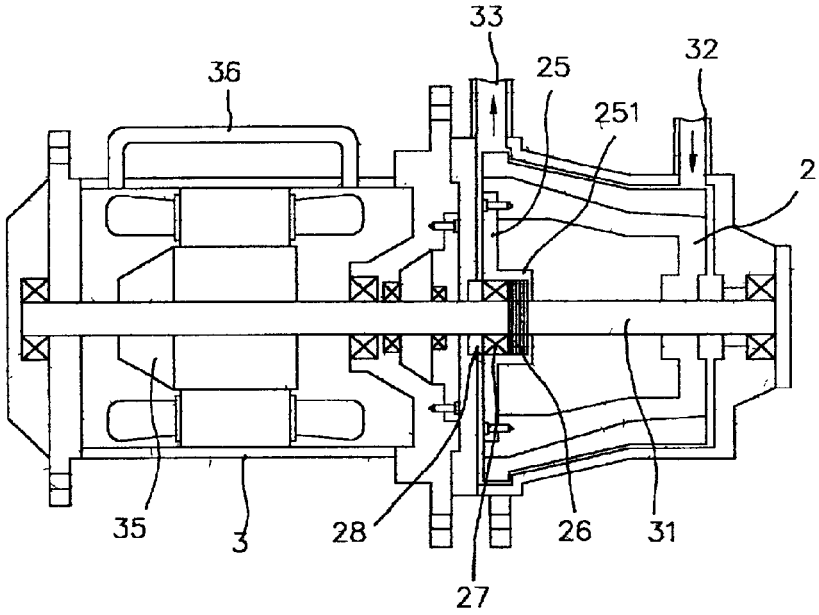
FIG. 6 is a cross-sectional view of a first embodiment of a motor and its blade unit in the present invention.

FIG. 6 shows that a first preferred embodiment of a motor and its blade unit in the present invention, includes a blade unit 2, a motor 3 and a rotating shaft 31 as main components combined together.

The rotating shaft 31 connects the blade unit 2 with the motor 3 and is driven by the motor 3 to rotate together with the blade unit 2. The motor 3 can carry on pumping and conveying water even though connected with only one blade unit 2. The motor 3 pumps in water through a water inlet 32 and guides water to flow out through a water outlet 33.

Figure 7:
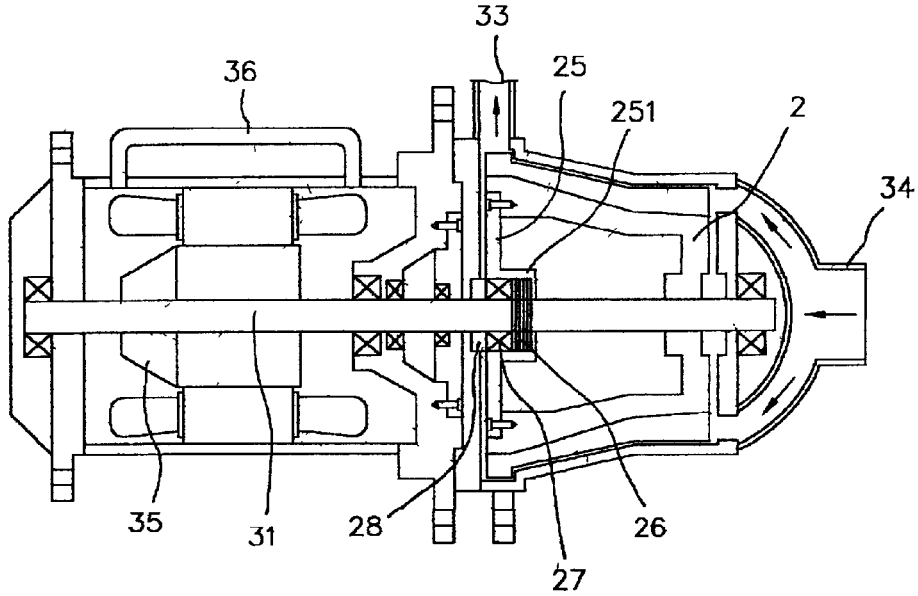
FIG. 7 is a cross-sectional view of a second embodiment of a motor and its blade unit in the present invention.

FIG. 7 shows that a second preferred embodiment of a motor and its blade unit in the present invention has the same structure as that of the first preferred embodiment, except that a water flowing-in pipe 34 takes place of the water inlet 32 in the first preferred embodiment.

When water flows through the blade unit 2, the blades of the blade unit 2 can not only cut impurities in water to prevent the motor from clogged by the impurities, but also guide water to flow out quickly with help of the slant of the conical blade unit 2 and the centrifugal force produced by rotating of the blade unit 2.

In addition, the blade unit 2 has its bottom fitting with a cover member 25. The cover member 25 is fitted around the rotating shaft 3 and formed with a recessed groove 251 in the center for receiving a spring 26. Then, an oil seal 27 is provided above and pressed by the spring 26, and a friction pottery ring 28 is disposed to press the oil seal 27. Thus, the spring 26 and the friction pottery ring 28 respectively press the oil seal 27 to let the oil seal 27 tightly seal the gap between the cover member 25 and the rotating shaft 31 to prevent water from flowing in the interior of the blade unit and giving rise to leaking.

The motor 3 has a fan blade 35 installed inside and an air-guiding pipe 36 inserted through its outer wall for transmitting air. Thus, when the motor 3 starts rotating, the rotating shaft 31 is driven to rotate together with the fan blade 35, and at this time cold air is pumped in to carry on thermo-interchanging with the inner components of the motor 3 and cool them off. Afterward, the hot air caused by thermo-interchanging is collected in the air guiding pipe 36 and cooled by the water around the outer side of the motor which is mostly used in deep water, and then pumped inside by the fan blade 35 to cool off the inner components of the motor once again.

Figure 8:
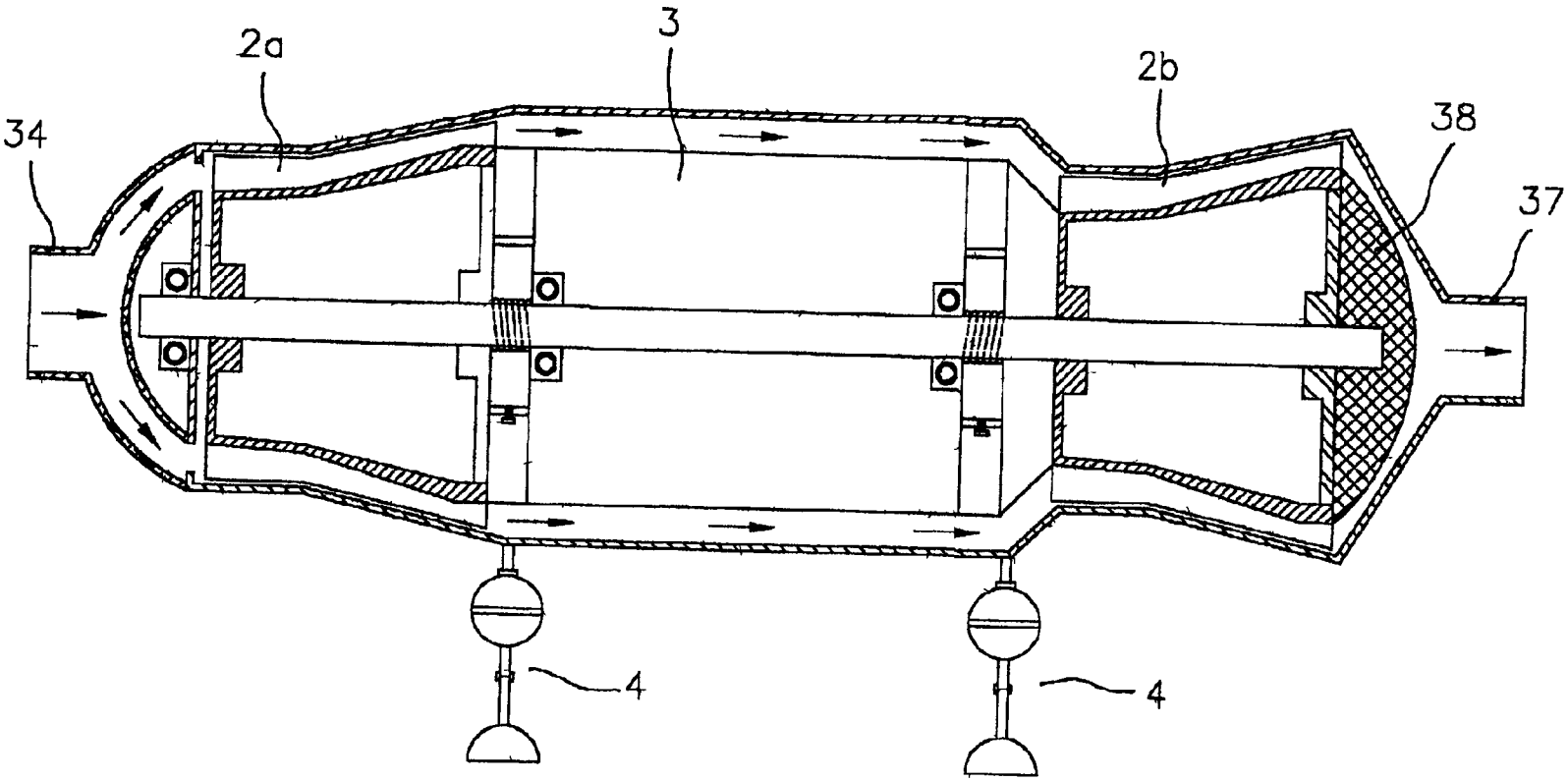
FIG. 8 is a cross-sectional view of a third embodiment of a motor and its blade unit in the present invention.

FIG. 8 shows a third preferred embodiment of a motor and its blade unit in the present invention. The motor 3 has a blade unit (2*a*) provided near its water inlet, and another blade unit (2*b*) near its water outlet for pumping in and guiding out water. Then, a water flowing-in pipe 34 is installed near the water inlet of the motor 3 to guide water to get in the blade unit (2*a*), and impurities in water is cut by the blades of the blade unit (2*a*) to prevent the motor 3 from clogged by impurities. At the same time, the slant of the conical blade unit (2*a*) and the centrifugal force produced by rotating of the blade unit (2*a*) enable water quickly pass through the outer wall of the motor 3 and flow to the blade unit (2*b*), and then quickly guided to get out of the motor 3 by the blade unit (2*b*) and the centrifugal force. Further, a pressure water passage 37 and a guide member 38 can be provided around the water outlet of the motor 3 to increase flowing-out pressure and speed of water.

As can be noted from the above description, the motor and its blade unit in this invention can increase water flowing-out speed, lower motor load and electricity consumption and save horsepower to prolong its service life, and also can be combined with various-typed motors for extensive use.

Figure 9:
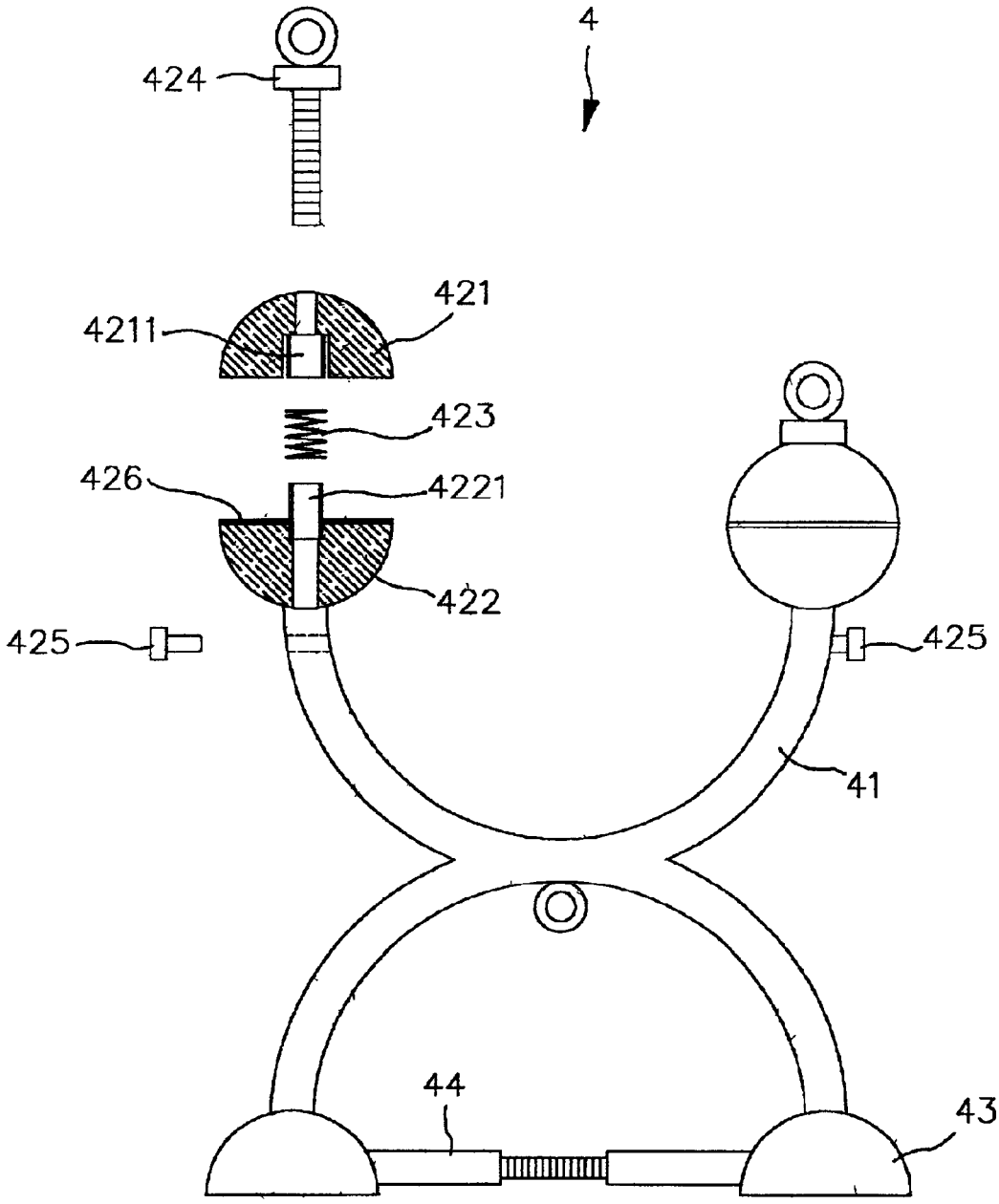
FIG. 9 is a cross-sectional view of a motor stand in the present invention.

Further, a motor stand 4 having effects of shock absorbing, muffling and height-adjusting can be additionally provided in the invention, as shown in FIG. 9. The motor stand 4 is an X-shaped resilient frame 41 having two semi-spheres 43 disposed spaced apart at opposite bottom sides, and two metal spheres 42 for shock absorbing and muffling respectively provided on opposite upper ends.

Each metal sphere 42 includes an upper semi-sphere 421 and a lower semi-sphere 422 combined together. The upper semi-sphere 421 is provided inside with a large sleeve 4211 fitted around with a spring 423, while the lower semi-sphere 421 is provided inside with a small sleeve 4221 to be closely fitted in the large sleeve 4211. Then, the upper semi-sphere 421 and the lower semi-sphere 422 are tightly combined together by means of a bolt 424 which has its end fastened by a pin 425. Thus, the upper semi-sphere 421 and the lower semi-sphere 422 can bear a comparatively large vibration, and the spring 423 can absorb part of the vibration to achieve an effect of shock absorbing. In addition, a rubber gasket 426 is closely sandwiched between the upper semi-sphere 421 and the lower semi-sphere 422 for muffling.

The X-shaped frame 41 has two semi-spheres 43 provided on opposite bottom ends to let the frame 41 positioned stably on the ground, having an adjusting threaded member 44 fitted between two semi-spheres 43 for adjusting the distance between the two semi-spheres 43 and the height of the frame 41.

Figure 10:
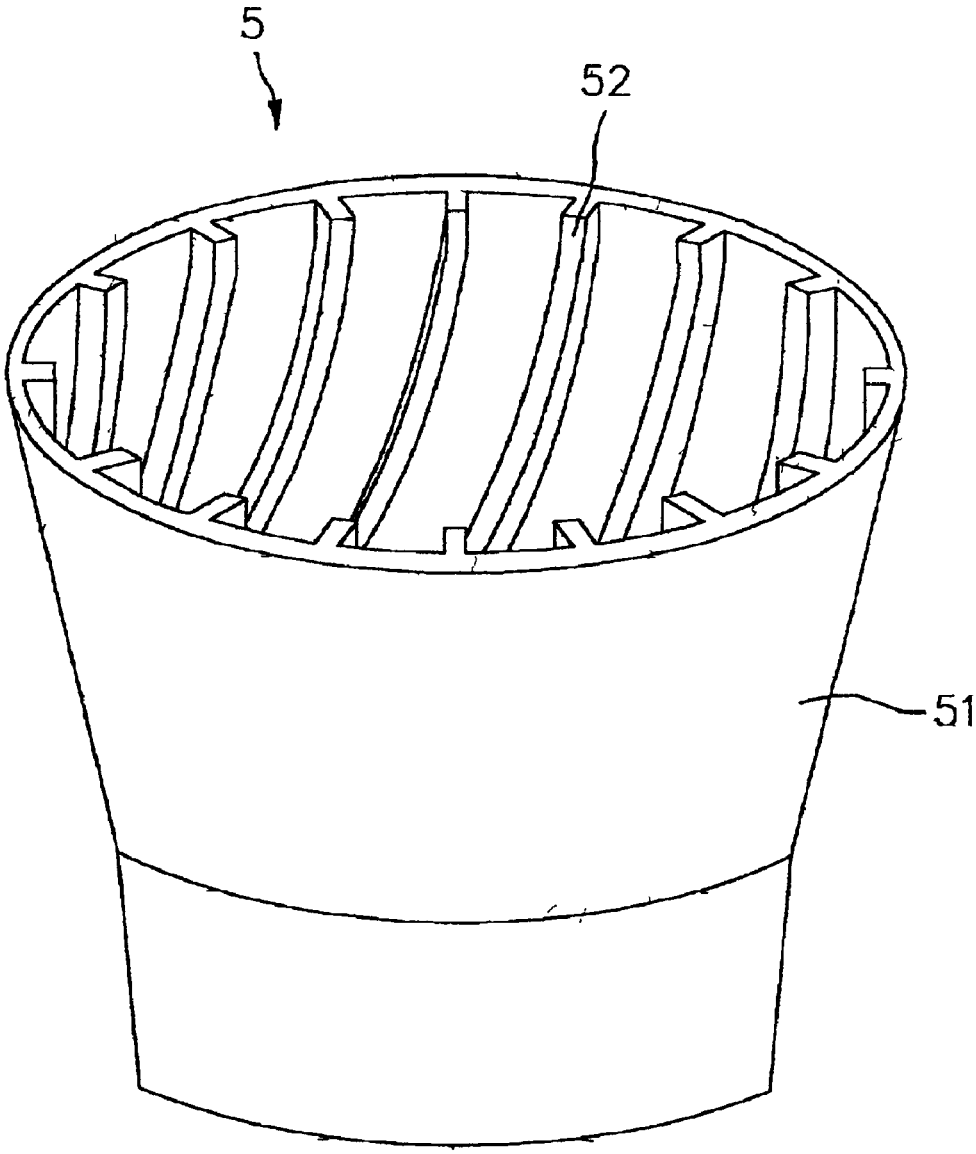
FIG. 10 is a perspective view of a fourth embodiment of a blade unit in the present invention.
Figure 11:
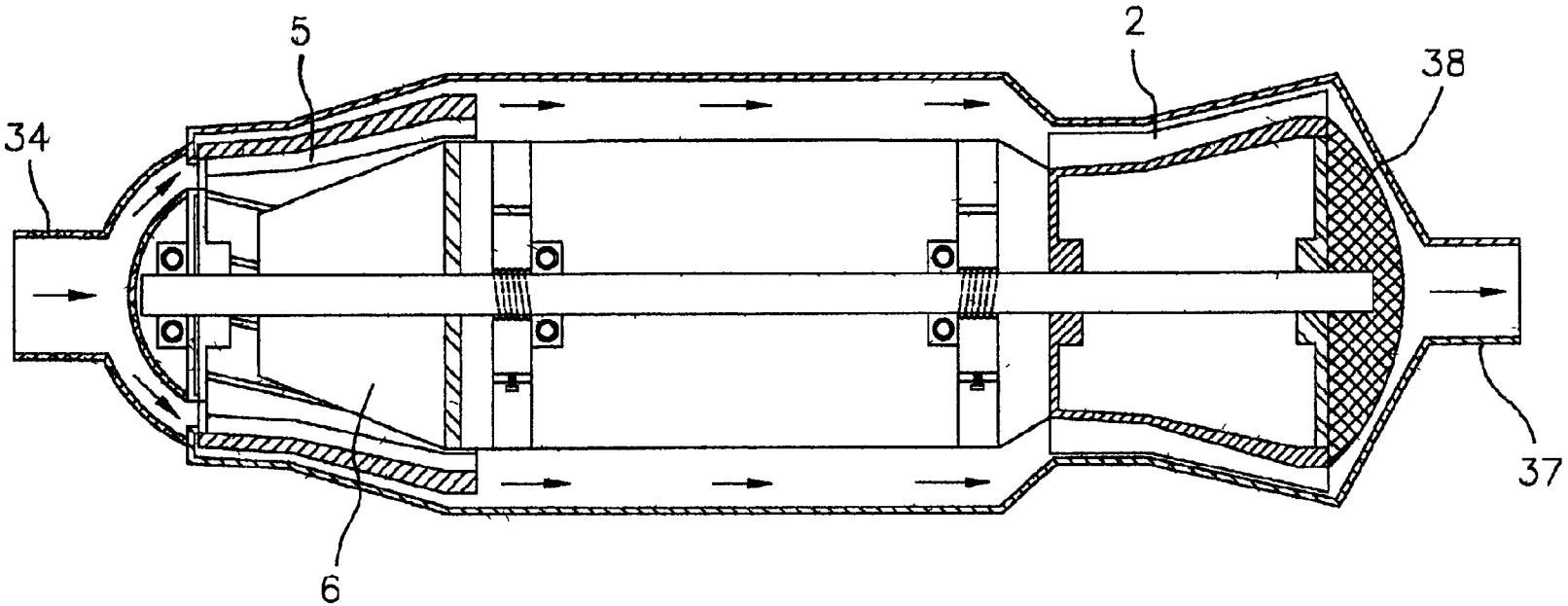
FIG. 11 is a cross-sectional view of a fourth embodiment of a motor and its blade unit in the present invention.

A fourth embodiment of a motor and its blade unit in the present invention, as shown in FIGS. 10 and 11, is provided with an inner blade unit 5 having its blades 52 formed around the inner wall of a fundamental body 51 to guide and speed up water flowing. The inner blade unit 5 is installed near the water inlet of the motor 3 and has a floating member 6 provided inside for resisting pressure of water coming in through a water flowing-in pipe 34 to let water not gather around the shaft and overflow, but flow forward quickly through the blades 52 with help of the centrifugal force produced by rotating of the inner blade unit 5.

In addition, the motor 3 can be provided with an outer blade unit 2 near its water outlet to guide water to fast flow out of the motor 3 with help of the blades of the outer blade unit 2 and its rotating centrifugal force. Then, a pressure water passage 37 and a guide member 38 are provided at the water flowing-out end of the motor 3 for guiding water to flow, and increasing water flowing-out pressure and speed.

While the preferred embodiment have been described above, it will be recognized and understood that various modifications nay be made therein and the appended claims are intended to cover all such modifications that may fall within the spirit and scope of the invention.

What is claimed is:

1. A motor and blade unit comprising:

a) a motor; and b) a blade unit including:

i. a fundamental body being a metal block with a top end, a bottom end, a hollow interior and a conical profile, a slant of said conical profile increasing water flowing speed, said top end of said fundamental body having a through hole receiving a shaft driven by the motor to rotate said fundamental body; and, ii. a plurality of blades protruding from a surface of said fundamental body, said plurality of blades including multi-sectioned blades of different sizes, guiding water to flow so as to separate impurities from the water to prevent the motor from being clogged by impurities, further comprising: a cover member fitted around said shaft and having a recessed groove in a center thereof receiving a spring; and an oil seal sandwiched and pressed between said spring and a friction ring sealing a gap between said cover member and said shaft to prevent leakage.

2. A motor and blade unit comprising:

a) a motor; and b) a blade unit including:

i. a fundamental body being a metal block with a top end, a bottom end, a hollow interior and a conical profile, a slant of said conical profile increasing water flowing speed, said top end of said fundamental body having a through hole receiving a shaft driven by the motor to rotate said fundamental body; and, ii. a plurality of blades protruding from a surface of said fundamental body, said plurality of blades including multi-sectioned blades of different sizes, guiding water to flow so as to separate impurities from the water to prevent the motor from being clogged by impurities, further comprising: a fan blade fitted in an interior of said motor; and an air guiding pipe inserted through an outer wall of said motor for transmitting air, said fan blade pumping in cold air to cool inner components of said motor.

* * * * *